United States Patent [19]

Foss

[11] 4,113,128

[45] Sep. 12, 1978

[54] LIFT FORK CONSTRUCTION

[75] Inventor: Richard W. Foss, Thompson, Ohio

[73] Assignee: Jos. Dyson & Sons, Inc., Eastlake, Ohio

[21] Appl. No.: 776,283

[22] Filed: Mar. 10, 1977

[51] Int. Cl.[2] ..... B66F 9/14

[52] U.S. Cl. ..... 214/750; 214/731

[58] Field of Search ..... 214/730, 731, 750

[56] References Cited

U.S. PATENT DOCUMENTS

| | | | |
|---|---|---|---|
| 2,975,924 | 3/1961 | Kopanski | 214/750 |
| 3,027,033 | 3/1962 | Schuster | 214/750 |
| 4,002,256 | 1/1977 | Krobath | 214/750 |

FOREIGN PATENT DOCUMENTS

| | | | |
|---|---|---|---|
| 218,967 | 9/1957 | Australia | 214/731 |
| 1,405,352 | 5/1965 | France | 214/731 |
| 1,315,865 | 5/1973 | United Kingdom | 214/731 |

*Primary Examiner*—Lawrence J. Oresky
*Attorney, Agent, or Firm*—Frank B. Robb

[57] ABSTRACT

There is disclosed lift fork construction including a hook portion at one end of the fork body which includes resiliently controlled latch instrumentalities arranged to be raised and lowered into and out of engagement with notches formed in a support member carried by a lift truck, rotation of a T-shaped member included in the said instrumentalities to an angle to extend across a notch, preventing engagement therewith, means being provided to manipulate said member to move the same into position coinciding with a notch and thereby enter the same to lock the fork in position on the support member aforesaid.

2 Claims, 9 Drawing Figures

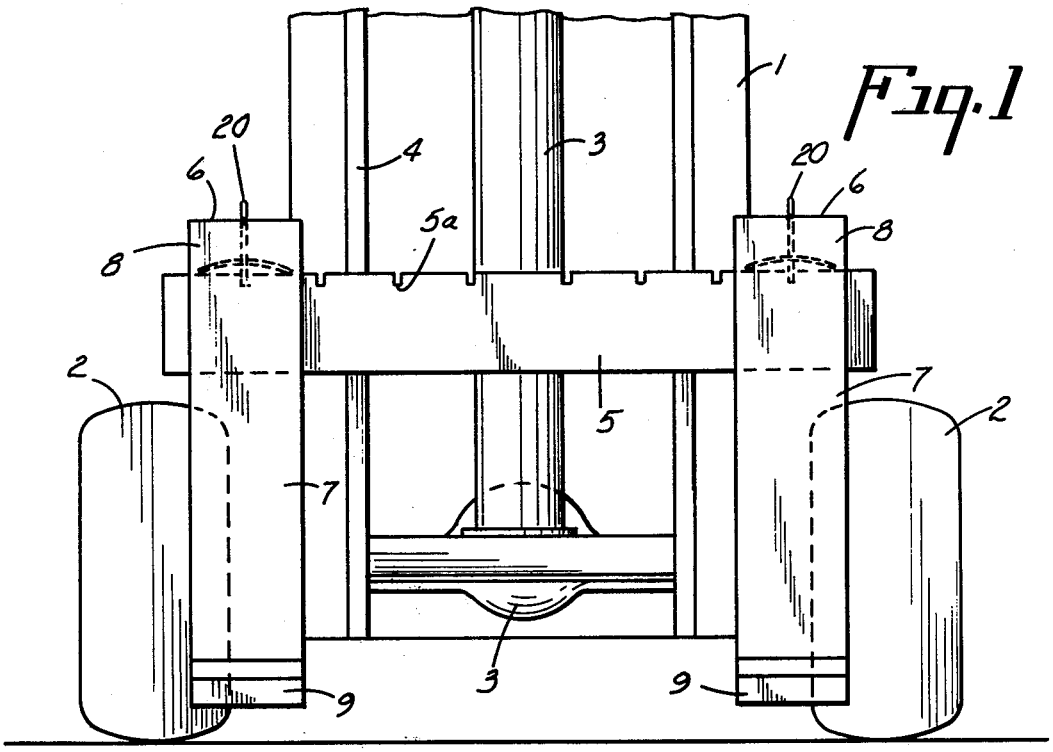
Fig. 1
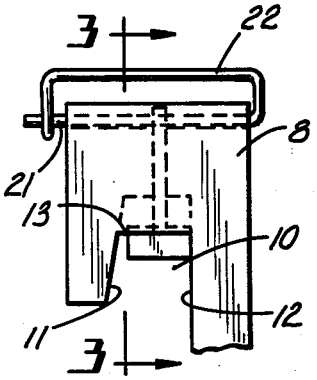
Fig. 2
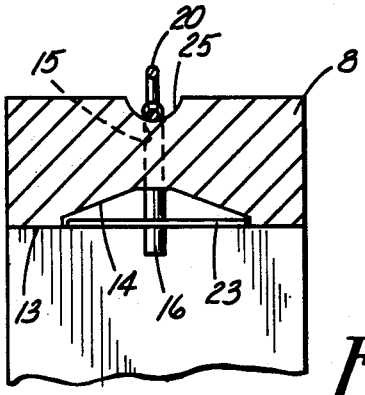
Fig. 3
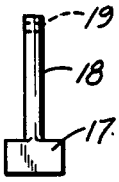
Fig. 6
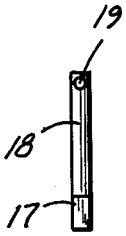
Fig.
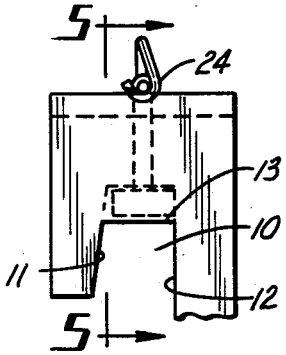
Fig. 4
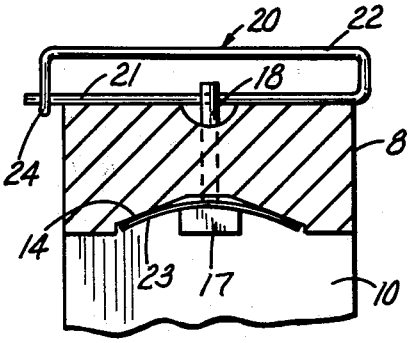
Fig. 5
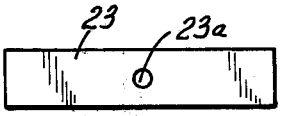
Fig. 8
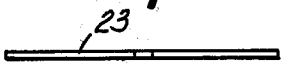
Fig. 9

LIFT FORK CONSTRUCTION

OBJECTS OF THE INVENTION

It is a principal object of this invention to provide lift fork constuction, which will enable the positioning of a lift fork or pair thereof upon a lift truck, which lift truck carries a support member transversely thereof usually at the forward portion, the support member having a series of spaced notches therein, for purposes which will be apparent, the object being to provide a fork with means to enter the notches, and thereby prevent displacement longitudinally or transversely of the forks when the notches are engaged, by certain instrumentalities provided.

It is a more detailed object of this invention to provide such latch instrumentalities for use with lift fork construction, which latch instrumentalities are mounted in a hook portion of the fork, which hook portion engages the transverse support, and by manipulation of these latch instrumentalities causes engagement of the notches thereby, or raises the instrumentalities out of engagement with the notches so that the fork can be moved from side to side.

Another object of the invention is to provide novel latch instrumentalities which are formed in the hook portion of the lift fork, and specifically in the support section of that fork, so that the latch instrumentalities which include a T-shaped member, are resiliently maintained in engagement with the support member and means are provided to raise the same out of the notches and thereby permit movement of the forks along the support member.

Another object of the invention is to so form the latch instrumentalities that they are simple to assemble, do not obstruct the actual use of the fork, and are easy to manipulate for the purposes intended.

Other and further objects of the invention will be understood from a consideration of the specification appended hereto and disclosed in the drawing wherein:

FIG. 1 is a front view of a lift truck somewhat diagramatic in nature showing the mounting of a support member thereon and forks carried thereby to indicate the environment of the invention.

FIG. 2 is a sectional fragmentary view, showing the latch instrumentalities in latching position.

FIG. 3 is a view taken on a line 3—3 of FIG. 2 looking in the direction of the arrows.

FIG. 4 is a view similar to FIG. 2 but in this instance the latch instrumentalities are disengaged or in disengaged position.

FIG. 5 is a view taken about on a line 5—5 of FIG. 4 looking in the direction of the arrows.

FIG. 6 is a view of the T-shaped member, from one aspect and FIG. 7 is a view at right angles to the view of FIG. 6.

FIG. 8 is a plan view of the leaf spring provided in the construction.

FIG. 9 is a side view or edge view of such leaf spring.

DESCRIPTION OF THE INVENTION

Referring now to FIG. 1, a lift truck is indicated at 1, and disclosed as supported on wheels 2, the usual drive axle 3 being provided and suitable power means also though not shown, this being a common type of lift truck and provided with a lift cylinder such as 3, connected to a lift frame 4 which in turn supports a transverse support member 5, the hydraulic piston and cylinder unit 3 being arranged to raise and lower this support member 5 and in turn the usual lift forks supplied thereon in this case being specially formed however and denoted 6.

As suggested, these lift forks 6 include the usual body, having the upright section 7 thereof with a hook 8 at the upper end and the tine or lift portion at the lower end and denoted 9, the forks being identical and thus only the fork shown in FIG. 1 at the left hand being described in detail from here on in this description.

Referring particularily to the hook portion 8 of the lift fork, it is shown as having at its interior so to speak, as suggested in FIGS. 2–5 inclusive, a generally U-shaped area 10, which U-shaped section includes the downwardly extending short leg 11 and a longer leg 12 with a transverse connection 13 which extends across the fork and as suggested particularily in FIGS. 3 and 5, is of substantial transverse extent but is provided at its central portion with a recess or cavity 14 for purposes which will be obvious as this description proceeds.

About centrally in the hook portion 8, is a vertical round hole 15, which is adapted to receive there within a T-shaped member 16, having the head or cross-arm 17 thereof connected to a round vertical element 18, this T-shaped member obviously being inverted for the purposes hereof.

At the upper end of the vertical element 18, is a transverse opening 19, adapted to receive a handle or operating part 20, which is a sort of safety pin arrangement including a lower member 21 and a U-shaped inverted portion 22, connected thereto there being a hook section 24 at one end to engage the part 21.

The part 21 of course extends through the opening 19, and by grasping the U-shaped portion 22 the T-shaped member 18 may be raised or lowered.

The recess 14 is provided to receive a flat leaf spring 23, so that when the leaf spring is bent into the condition shown in FIG. 5, it is fully received within the cavity or recess 14, with the cross-arm or head of the T-shaped member 18 effecting such bending action, and at the same time permitting the member to be raised out of the one of the notches which may be designated 5*a* of the support member 5 previously referred to and shown specifically of course in FIG. 1.

With the T-shaped member in one position as in FIG. 3, the same may be permitted to move downwardly under the compulsion of the spring 23, so that it enters the notch or a notch 5*a* for example, and thus prevents transverse displacement of the fork with which the same is associated.

By the same token, raising upwardly on the handle or operating part 22, will withdraw the head or cross-arm 17 from a notch 5*a*, and in order to maintain the said head 17 out of engagement with the notch, rotation of the handle or operating part 22 will position the same so as to extend as shown in FIG. 5 and at the same time cause the head 17 to bridge the notch such as 5*a*.

It will be understood that certain limits of movement may be effected to cause the action just before described, and when it is desired to have the member 17 or cross-arm 17 in notch engaging position, rotation of the part 22 may be resorted to, and since there is a recess 25 extending across the hook portion 8, the handle may thereby drop into that recess as shown in FIGS. 2 and 3, and thus lock the latch member 16 in position with the head or cross-arm 17 in notch engaging position as suggested.

If the latch element or instrumentalities are to be removed, the safety pin action may be resorted to of the handle or operating part 22 and removal will be effected as will be apparent.

The assembly of the unit is likewise similarily effected, and of course the leaf spring 23 has an opening 23*a* therein through which the vertical element 18 of the latch instrumentalities or T-shaped member can be introduced.

From the foregoing the operation of the latch instrumentalities should be clearly understood, and includes the lifting and rotating, to maintain the latch in disconnected or upraised position out of engagement with the notch such as 5*a* so that the fork with which it is associated may be moved transversely on a support member such as 5.

I claim:

1. In lift fork construction of the class described, in combination, a fork body, a hook portion at one end thereof to engage a transverse support member on a lift truck in which support member a series of spaced notches is formed, latch instrumentalities carried by a hook portion and selectively engageable with the notches aforesaid, means to maintain said latch instrumentalities in engaging position, means to prevent such engagement, the latch instrumentalities comprise an inverted T-shaped member, the vertical element thereof extending upwardly through the hook portion and the cross-arm constituting a plate-like element having a width approximating the width of a notch to engage with the notches and likewise prevent such engagement, and an operating part connected to the vertical element above the hook portion to manipulate the latch instrumentalities, resilient means engaging the said member to maintain the same in notch engaging position, the said resilient means comprising a flat spring, a recess in the hook portion to locate the flat spring, said recess being formed to prevent bending of the spring thereinto when the T-shaped member is raised by the operating part.

2. The combination as claimed in claim 1, wherein the latch instrumentalities including said resilient means engaging the said member to maintain the same in notch engaging position and the operating part is arranged to facilitate lifting and rotating action of the member, the means to prevent engagement of the member being operative upon rotation thereof for such preventative action.

* * * * *